United States Patent [19]

Bishop

[11] 4,367,069

[45] Jan. 4, 1983

[54] APPARATUS FOR STRIPPING SCRAP FROM DIE CUT BLANKS

[75] Inventor: Thomas D. Bishop, Solihull, England

[73] Assignee: The Deritend Engineering Company Ltd., Birmingham, England

[21] Appl. No.: 230,872

[22] Filed: Feb. 2, 1981

[30] Foreign Application Priority Data

Mar. 20, 1980 [GB] United Kingdom ..... 8009356

[51] Int. Cl.[3] ..... B26F 3/02; B31B 1/74

[52] U.S. Cl. ..... 493/342; 83/103; 83/117; 225/97; 225/99

[58] Field of Search ..... 83/103, 117; 493/342; 225/97, 98, 99

[56] References Cited

U.S. PATENT DOCUMENTS

| | | | |
|---|---|---|---|
| 687,905 | 12/1901 | Seymour et al. | 83/117 |
| 1,466,001 | 8/1923 | Metzner et al. | 83/117 X |
| 2,711,676 | 6/1955 | Richardson et al. | 493/342 |
| 3,877,353 | 4/1975 | Smith et al. | 83/103 X |
| 3,949,653 | 4/1976 | Schröter | 83/103 X |

*Primary Examiner*—Frank T. Yost

*Attorney, Agent, or Firm*—C. O. Marshall, Jr.

[57] ABSTRACT

Stripping apparatus to remove scrap around die cut blanks in a web comprises a roll pair through which the web is passed, one roll carrying spikes to impale the scrap pieces and the other roll carrying abutments to contact the scrap pieces on the opposite side to the spikes. According to the invention the abutments are retractable, so that effectively the scrap piece is pinched between the spike and abutment shortly before the nip of the rolls. FIG. 1 illustrates the preferred arrangement.

3 Claims, 3 Drawing Figures

APPARATUS FOR STRIPPING SCRAP FROM DIE CUT BLANKS

DESCRIPTION

This invention relates to strippers for use with a rotary die cutting of sheet material.

Modern practice uses such material in the form of so-called continuous web in substantial widths, which is die cut and sometimes printed without any preliminary step of cutting the web into individual blanks. This minimises costs, particularly where large quantities of identical articles are to be made, for example containers for the food trades. The parts being cut are often of complex shape and may be provided with crease lines where the parts are to be folded or hinged. The dies are arranged to cut the maximum number of parts from the web, but inevitably areas of scrap material are formed because of the complexity of the shapes. At a certain stage some or all of the scrap is separated from the parts, and this operation is known as stripping.

It is known from BP No. 1074291 to effect stripping by spike-like parts projecting from one roll and arranged to stab the scrap pieces as the web passes through the roll nip. The impaled scrap is removed at an angularly spaced location in roll rotation.

If a long production run is intended, the dies may be formed out of the surface of the rolls and the stripping may be accomplished in the die cutting roll pair. In this case the spikes contact the web in an area not yet die cut. If the web resists impalement the spikes (for there may be series of these for example in rows across the roll) may cause a ripple or bulges in the web. If the web material is a soft metal foil or plastics, or a laminate of these, the ripple or bulges may become permanent, and in any case the accuracy of the cut shapes may be affected.

If shorter runs are envisaged the dies are often made detachable and then it may be necessary or convenient to use a separate roll pair for stripping, synchronised with the die cutting pair. In this case the web is already die cut when contacted by the spikes, and the pieces to be impaled are surrounded by cut lines, although the scrap still lies co-planar with the web. If impalement is resisted the result may be that the scrap pieces become prematurely detached from the web and cause problems elsewhere in the operation.

In accordance with the invention, stripping apparatus of the kind comprising a spike carried by one roll of a roll pair is characterised by the provision of a cooperating abutment carried by the second roll of the pair, the spike and abutment being synchronised so as to contact the scrap piece on opposite faces of the same in advance of the nip between the rolls, and the abutment being retracted from projection beyond the roll surface as it approaches the nip.

Preferably the abutment is tubular so that the spike can be received in its bore when impalement is complete. Preferably also the retraction is cam controlled so that the abutment end sweeps along a straight line tangential to the roll surface and coplanar with the web.

By these means, the piece to be contacted and impaled on the spike is prevented from being displaced out of the plane of the web.

The invention is now more particularly described with reference to the accompanying drawings wherein.

Figure 1:
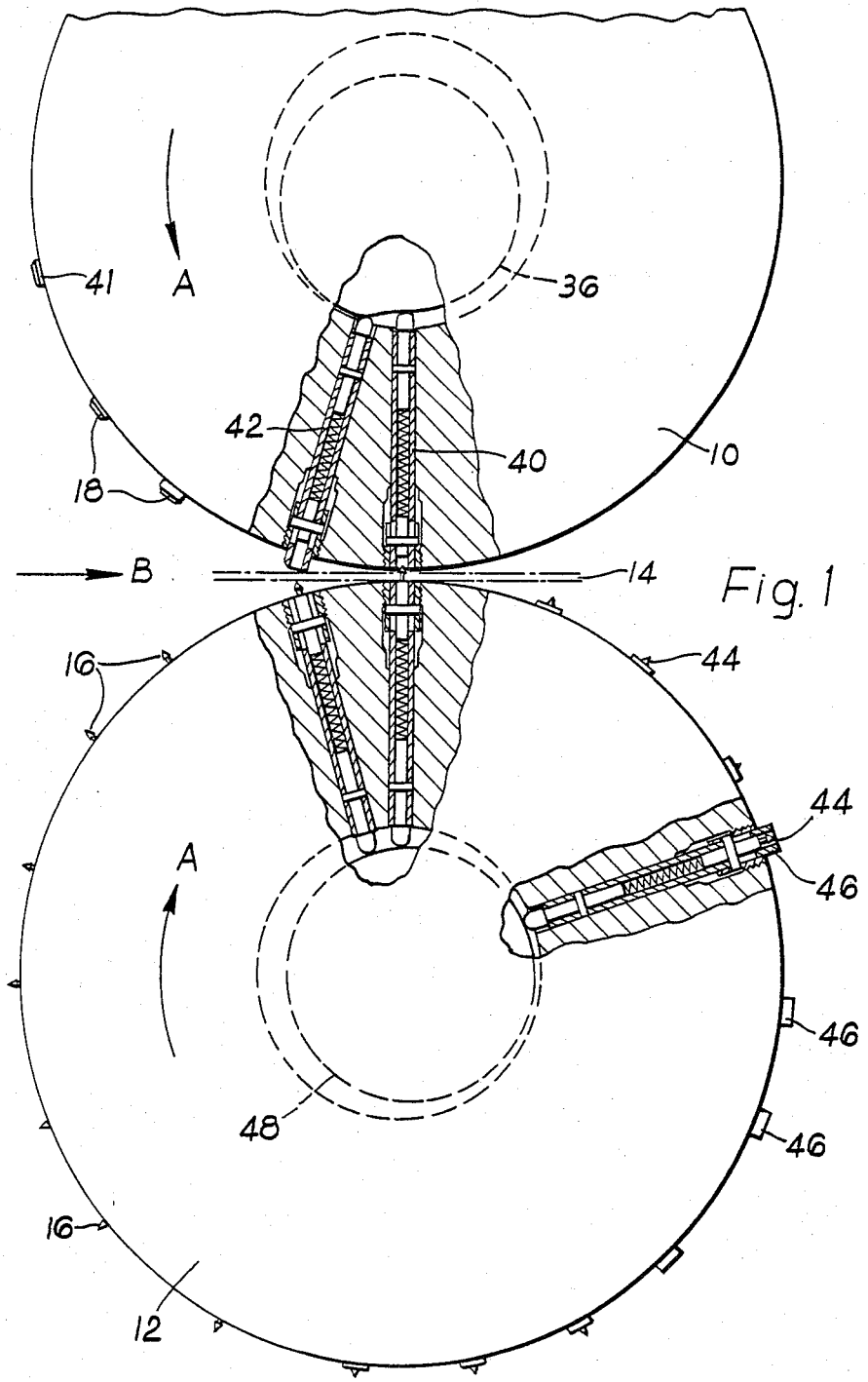
FIG. 1 is a fragmentary and part sectional elevation of a roll pair provided with the stripper of the invention.

Turning now to the drawings and particularly FIG. 1, there is shown a roll pair comprising an upper roll 10 and a lower roll 12 both of which are annular and of massive construction so as to be rigid, and which are arranged to rotate in the direction shown by the arrows A. The web to be stripped is fed in the direction of the arrow B through the roll nip, and the thickness of the web in the nip is indicated by the chain dot lines 14.

The roll 12 is provided with a series of spikes 16 which are synchronised for association with a series of abutments 18 provided on the roll 10.

Figure 2:
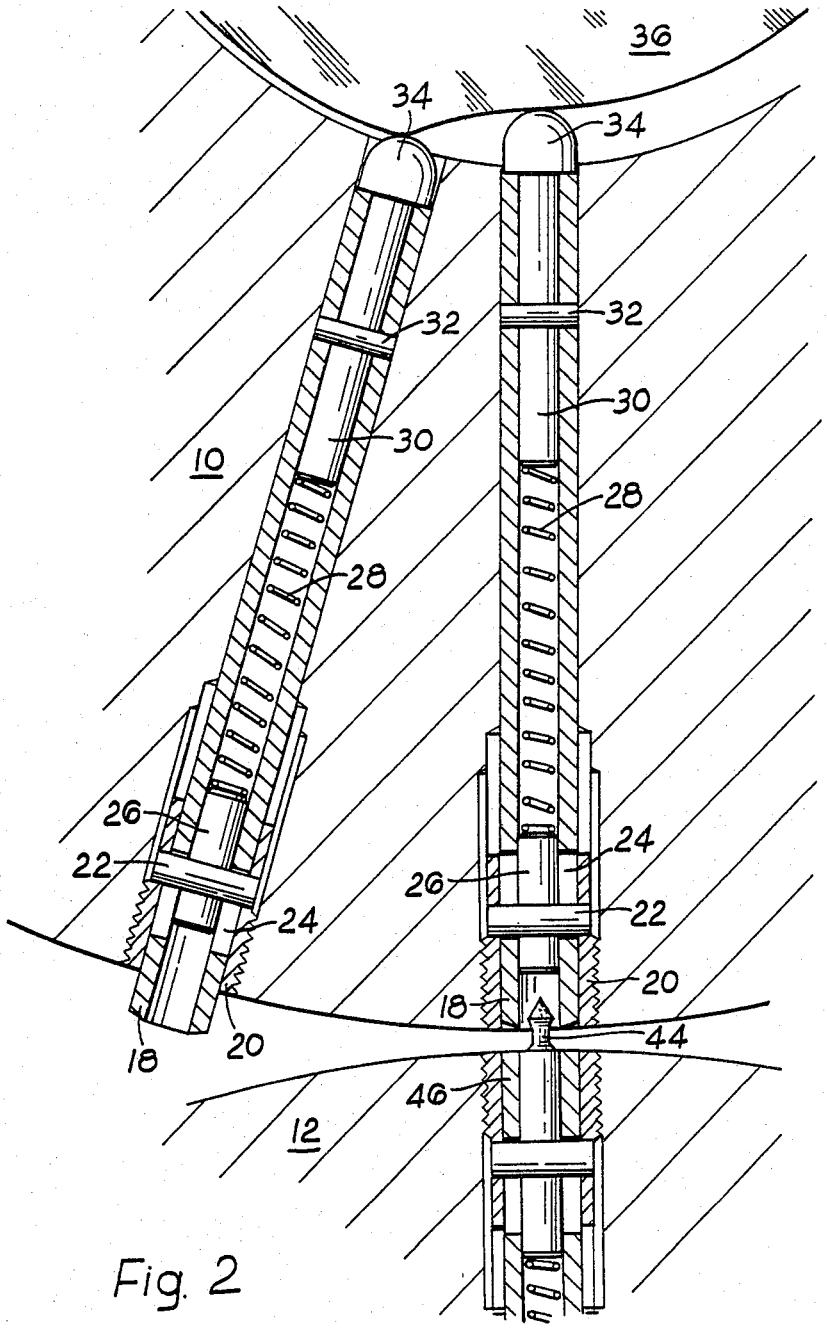
FIG. 2 is a fragmentary enlarged scale sectional view.

Construction of the abutments, and their operation, is best seen from FIG. 2. The abutment 18 is formed as one end of a tubular member which is slidable in a bore in the roll, being guided at its outer end by a bush 20 screwed into the face of the roll. The bush carries a cross pin 22 which extends through elongated slots 24 in the tube, and the pin extends through a first plug 26 which forms a seating for one end of a compression spring 28 lying in the tube bore, the opposite end of the spring seating against the second plug 30 which is cross pinned to the tube by a pin 32. The second plug 30 terminates in a cam follower 34.

The spring 28 tends to displace the whole of the abutment radially inwardly by reaction with the fixed plug 26. The inward displacement is controlled by a fixed cam 36 about which the roll 10 rotates. As will be seen from consideration of FIG. 1, wherein the whole of the cam 36 is shown by a broken line, the abutment shown as 40 on FIG. 1 is at its radially innermost position so that its outer end face is flush with the roll. As the abutment 40 travels about the cam it remains flush (although this is unimportant) until it has completed some 270° of a revolution when the cam commences to displace the abutment outwardly so that as shown at 41 FIG. 1 there is a slight projection, and so on until when at the position occupied by the abutment 42 FIG. 1 the projection is at a maximum and complete. The end face of the abutment then lies immediately adjacent to the true plane of the web. In movement from the position of the abutment 42 to the position of the abutment 40 FIG. 1, the shape of the cam ensures that the spring causes the inward movement so that the outer end effectively sweeps along the plane of the surface of the web.

Figure 3:
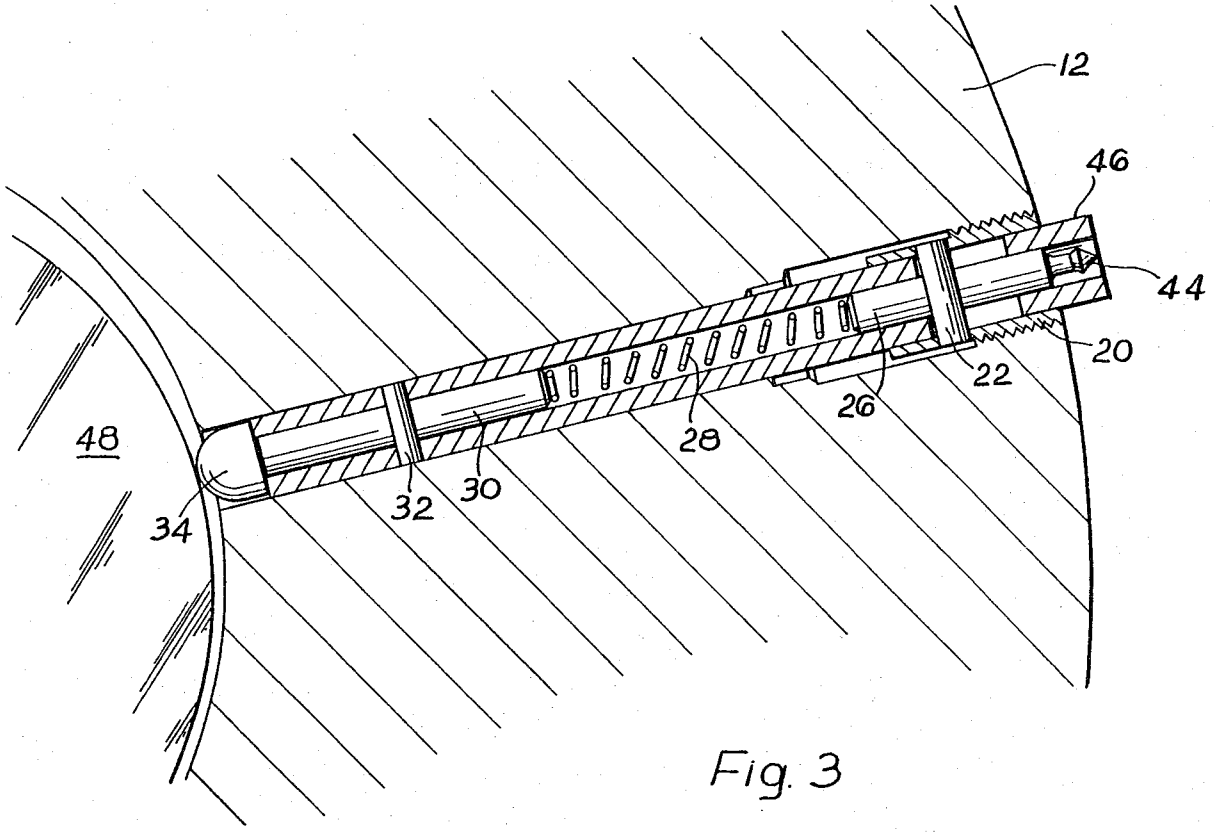
FIG. 3 is a different fragmentary sectional view.

Turning now to FIG. 3, it will be seen that the construction of the spike is generally similar to that of the abutment, save that the radially outermost plug is integral with the spike 44 and the spike projects beyond the surface of the roll. In the radially outermost position of the tube, the end part 46 surrounds the spike, and in the radially innermost position of the tube (shown in FIG. 2) the end part 46 is flush with the surface of the roll leaving the spike projecting.

The roll 12 is provided with an eccentrically running solid shaft 48 which contacts the cam follower part of the spike assembly and the eccentric shaft is driven at the same speed as the roll so that there is no relative rotation: this is to minimise wear. The effect of the eccentric shaft is similar to that of a cam, except that the tube is projected outwardly to a maximum extent at say 120° removed from the nip, so that any material impaled on the spikes is displaced from the impalement by the tube movement, for collection of the scrap pieces at a position remote from the nip. As the spikes approach the nip the tubes are wholly retracted.

It will be appreciated that the web is only contacted by the stripping spikes at a time when it is also contacted on the opposite face by the abutments, and because the abutment is controlled in position so that it cannot project beyond the true plane of the web, the risk of displacement or deformation is avoided.

Having now described my invention what I claim is:

1. Apparatus for stripping scrap from a web, comprising a pair of rolls rotatable in opposite directions about parallel axes in contact with opposite sides of the web, one roll carrying at least one radially movable tubular abutment and the other roll having a projecting spike for each such abutment, arranged to enter such abutment, and means for controlling radial movement of each tubular abutment to maintain the abutment extended substantially to the plane of one side of the web while the corresponding spike is penetrating the web from the other side, whereby the spike enters the tubular abutment and impales the web.

2. Apparatus as claimed in claim 1 wherein each spike is surrounded by a radially movable tubular end part having means for controlling its radial movement to cause it to move outward to strip impaled material from the spike as the spike approaches a position remote from the nip of the rolls.

3. Apparatus as claimed in claim 2 wherein said means comprises a shaft which is eccentric to the spike-carrying roll and which is driven at the same speed as said roll.

* * * * *